US005606759A

United States Patent [19]

Yang

[11] Patent Number: 5,606,759

[45] Date of Patent: Mar. 4, 1997

[54] BRUSH ASSEMBLY OF A CUP WASHING MACHINE

[76] Inventor: Jack Yang, No. 7, 39th Str., Lane 399, Sec. 3, Chungshan Rd., Tan Tzu Hsiang, Taichung Hsien, Taiwan

[21] Appl. No.: 559,066

[22] Filed: Nov. 16, 1995

[51] Int. Cl.[6] ..... B08B 9/087; A47L 15/37

[52] U.S. Cl. ..... 15/75; 15/65; 15/164

[58] Field of Search ..... 15/22.1, 23, 56–59, 15/65–75, 101, 104.9, 164, 165, 211–213

[56] References Cited

U.S. PATENT DOCUMENTS

| | | | |
|---|---|---|---|
| 668,189 | 2/1901 | Kayser | 15/65 |
| 702,010 | 6/1902 | Kayser | 15/65 |
| 937,019 | 10/1909 | Bethsold | 15/164 |
| 1,502,641 | 7/1924 | Dahl et al. | 15/75 |
| 1,837,389 | 12/1931 | Albany | 15/65 |
| 2,239,047 | 4/1941 | Mathiessen | 15/56 |
| 5,450,646 | 9/1995 | McHugh et al. | 15/22.1 |

*Primary Examiner*—Mark Spisich
*Attorney, Agent, or Firm*—Bacon & Thomas

[57] ABSTRACT

A brush assembly including a brush holder having a center axle hole fixedly secured to the output shaft of a motor and two elongated slots longitudinally aligned at two opposite ends, a master cylinder brush coupled to the output shaft of the motor for cleaning the inside of the loaded cup, and two auxiliary cylinder brushes slidably and perpendicularly coupled to the elongated slots of the brush holder and fixed in place by a respective screw for cleaning the outside of the loaded cup.

2 Claims, 4 Drawing Sheets

BRUSH ASSEMBLY OF A CUP WASHING MACHINE

BACKGROUND OF THE INVENTION

The present invention relates to cup washing machines, and relates more particularly to the brush assembly of a cup washing machine which can be conveniently adjusted to fit the size of the cup to be cleaned so that the inside as well as the outside of the cup can be effectively cleaned, and which can be manually operated when power supply fails.

FIG. 1 shows a cup washing machine according to U.S. Pat. No. 5,315,729 and German Pat. No. G9200551.9, which was invented by the present inventor. This structure of cup washing machine uses a motor to turn two cylinder brushes through the transmission of a plurality of transmission shafts and a set of gears. However, this structure of cup washing machine still has drawbacks. When the cup washing machine is operated, the inside of the cup can be well cleaned, however the cup must be rotated manually so that the outside of the cup can be well cleaned. Another drawback of this structure of cup washing machine is that the pitch between the two cylinder brushes can only be adjusted within a limited range because of the limitation of the eccentric wheel. If to broaden the adjustable range between the two cylinder brushes, the manufacturing cost of the cup washing machine will be greatly increased.

SUMMARY OF THE INVENTION

It is one object of the present invention to provide a brush assembly for a cup washing machine which can be conveniently adjusted to fit the size of the cup to be cleaned so that the inside as well as the outside of the cup can be effectively cleaned. It is another object of the present invention to provide a brush assembly for a cup washing machine which can be manually operated when power supply fails. According to one aspect of the present invention, the brush assembly comprises a brush holder having a center axle hole fixedly secured to the output shaft of a motor and two elongated slots longitudinally aligned at two opposite ends, a master cylinder brush coupled to the output shaft of the motor for cleaning the inside of the loaded cup, and two auxiliary cylinder brushes slidably and perpendicularly coupled to the elongated slots of the brush holder and fixed in place by a respective screw for cleaning the outside of the loaded cup. According to another aspect of the present invention, a handle is provided having a shaft for fastening to the axle hole of the brush holder and the master cylinder brush when the brush holder and the master cylinder brush are disconnected from the output shaft of the motor, for permitting the brush holder and the master cylinder brush to be turned manually.

DETAILED DESCRIPTION OF THE PREFERRED EMBODIMENT

Figure 1:
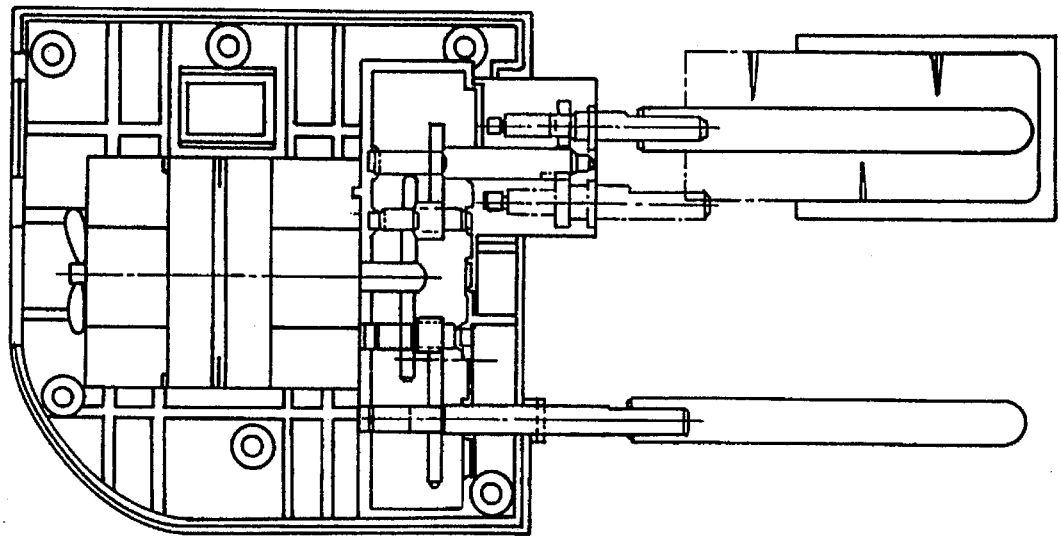
Fig. 1 PRIOR ART
FIG. 1 is a sectional view of a cup washing machine according to U.S. Pat. No. 5,315,729.
Figure 2:
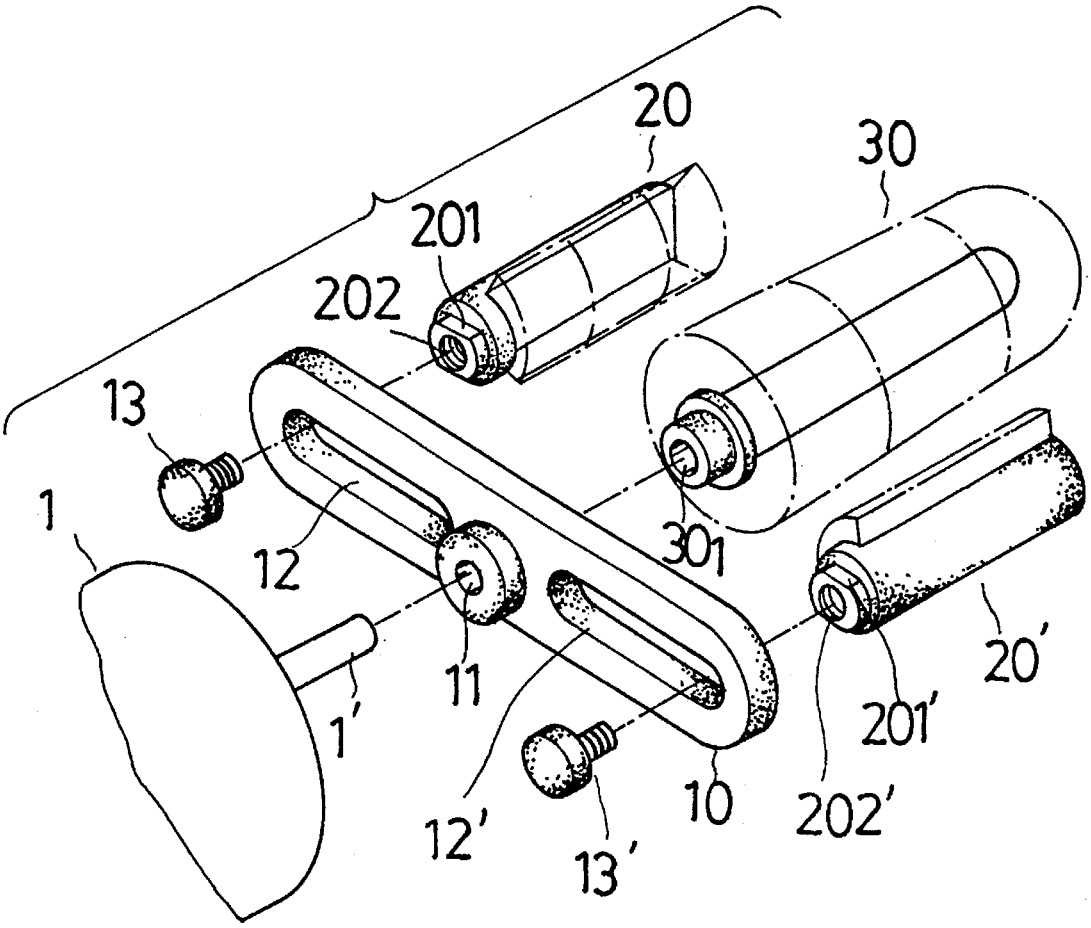
FIG. 2 is an exploded view of a brush assembly according to the present invention.

Referring to FIG. 2, the brush assembly of the preferred embodiment of the present invention comprises a motor 1, a brush holder 10, a master cylinder brush 30, and two auxiliary cylinder brushes 20 and 20'. The brush holder 10 is made of flat, elongated shape having an axle hole 11 at the center, and two elongated slots 12 and 12' longitudinally aligned at two opposite ends. The motor 1 has an output shaft 1' securely fastened to the axle hole 11 of the brush holder 10. The master cylinder brush 30 has a coupling hole 301 at one end fixedly secured to the output shaft 1' of the motor 1. The master cylinder brush 30 is fastened to the output shaft 1' of the motor 1 after the output shaft 1' of the motor 1 is fitted into the axle hole 11 of the brush holder 10. Each of the auxiliary cylinder brushes 20 and 20' has a coupling portion 201 or 201' at one end slidably inserted into one elongated slot 12 or 12' of the brush holder 10, and a screw hole 202 or 202' on the coupling portion 201 or 201' for fastening. A screw 13 or 13' is threaded into the screw hole 202 or 202' to fix the auxiliary cylinder brush 20 or 20' to the brush holder 10. By loosening the screw 13 or 13' the position of the auxiliary cylinder brush 20 or 20' can be adjusted relative to the master cylinder brush 30.

Figure 3:
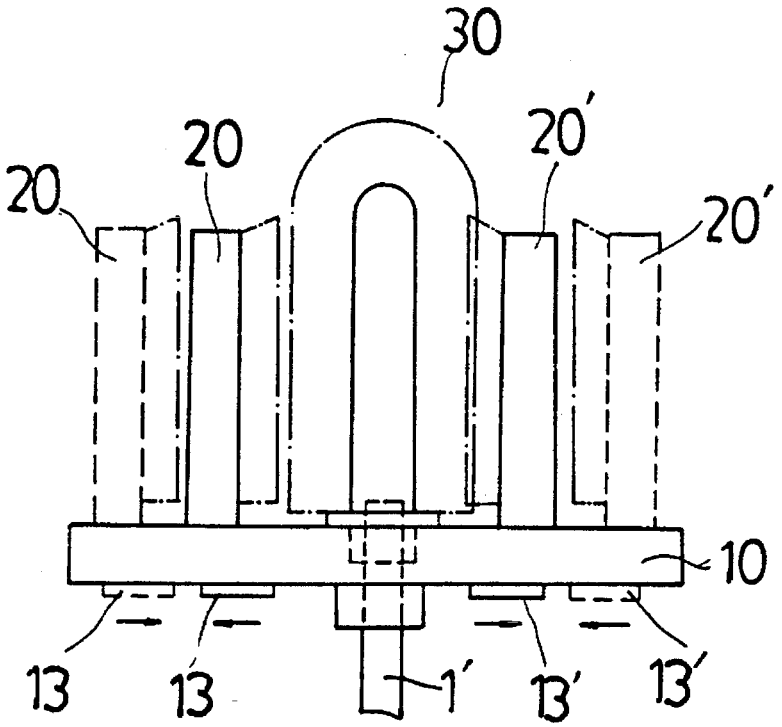
FIG. 3 is a schematic drawing showing the auxiliary cylinder brushes adjusted relative to the master cylinder brush according to the present invention.
Figure 4:
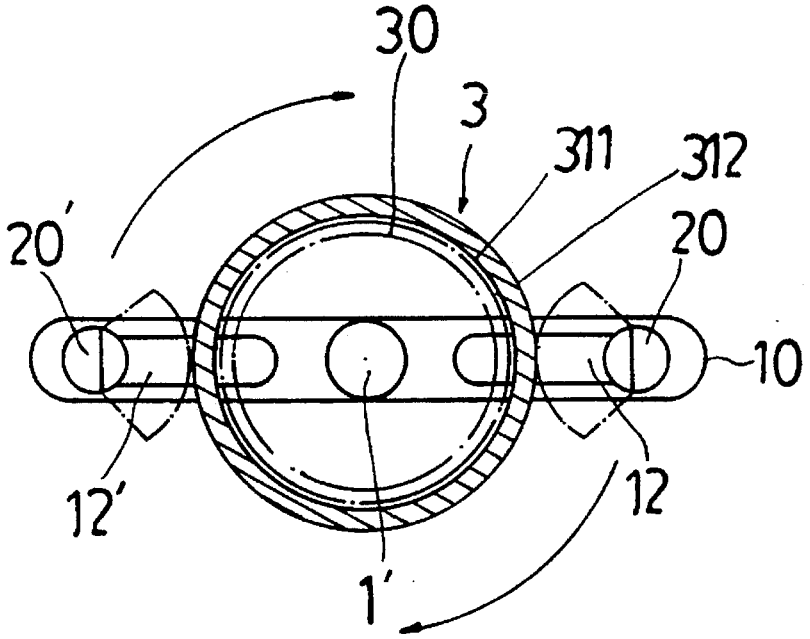
FIG. 4 is a top view of the brush assembly shown in FIG. 2, showing the brush holder rotated.

Referring to FIGS. 3 and 4, when a cup 3 is loaded on the master cylinder brush 30, the auxiliary cylinder brushes 20 and 20' are respectively adjusted and closely attached to the outside wall of the cup 3. When the motor 1 is started, the brush holder 10 is turned round and round by the output shaft 1' of the motor 10, causing the master cylinder brush 30 to clean the inside 311 of the cup 3 and the auxiliary cylinder brushes 20 and 20' to clean the outside 312 of the cup 3. Furthermore, the revolving speed of the motor 1 is preferably controlled within about 120 rpm, so as to prevent water from being caused to scatter in drops.

Figure 5:
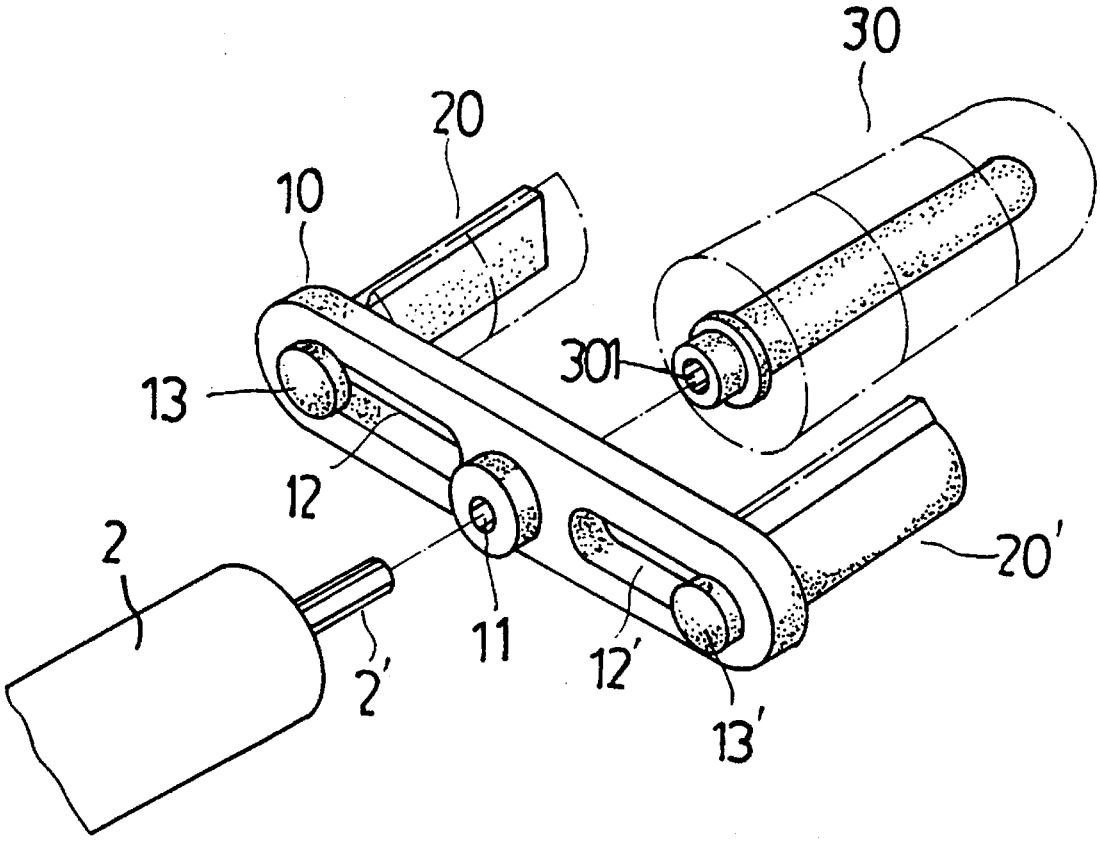
FIG. 5 is an exploded view of an alternate form of the present invention.

Referring to FIG. 5, if the motor 1 cannot be operated due to power failure, the brush holder 10 and the master cylinder brush 30 are disconnected from the output shaft 1' of the motor 1 and then fastened to the shaft 2' of a handle 2, for permitting the brush holder 10 and the master cylinder brush 30 to be turned manually.

I claim:

1. A brush assembly in a cup washing machine, comprising a motor having an output shaft, a brush holder fastened to the output shaft of said motor, a master cylinder brush coupled to the output shaft of said motor and turned by same for cleaning the inside of a cup, and two auxiliary cylinder brushes bilaterally and perpendicularly mounted on said brush holder for cleaning the outside of said cup, wherein said brush holder has an axle hole which receives said output shaft and which is located in a central portion of said brush holder intermediate first and second ends thereof, and two elongated slots longitudinally aligned on opposite sides of said axle hole and located adjacent the first and second respective ends of said brush holder for mounting said auxiliary cylinder brushes, said master cylinder brush has a coupling hole aligned with said axle hole at one end coupled to the output shaft of said motor, each of said auxiliary cylinder brushes has a coupling portion at one end thereof which is slidably inserted into a respective one of said elongated slots of said brush holder and fixed in place by a screw, and a screw hole on each said coupling portion for fastening the respective screw.

2. The cup washing machine of claim 1 further in combination with a handle having a shaft for fastening to the axle hole of said brush holder and the coupling hole of said master cylinder brush when said brush holder and said master cylinder brush are disconnected from the output shaft of said motor, for permitting said brush holder and said master cylinder brush to be turned manually.

* * * * *